US005814778A

United States Patent [19]

Schell

[11] Patent Number: 5,814,778

[45] Date of Patent: Sep. 29, 1998

[54] MULTIPLE SPHERE MOTION DETECTOR

[75] Inventor: Jerry Schell, Chanute, Kans.

[73] Assignee: Schell Electronics, Inc., Chanute, Kans.

[21] Appl. No.: 796,579

[22] Filed: Feb. 6, 1997

[51] Int. Cl.[6] ..... H01H 35/14

[52] U.S. Cl. ..... 200/61.45 R; 200/61.51; 200/61.52

[58] Field of Search ..... 200/61.45 R–61.45 M

[56] References Cited

U.S. PATENT DOCUMENTS

| | | | |
|---|---|---|---|
| 3,539,740 | 11/1970 | Isenor et al. | 200/61.45 |
| 3,742,478 | 6/1973 | Johnson | 340/262 R |
| 3,760,733 | 9/1973 | Marchiando | 102/70.2 R |
| 3,763,484 | 10/1973 | Byers | 340/262 |
| 3,816,680 | 6/1974 | Suzuki et al. | 200/61.51 |
| 4,450,326 | 5/1984 | Ledger | 200/61.45 M |
| 5,010,893 | 4/1991 | Sholder | 128/782 |
| 5,153,566 | 10/1992 | Yun | 340/689 |
| 5,168,138 | 12/1992 | Evans | 200/61.52 |

*Primary Examiner*—Michael A. Friedhofer
*Attorney, Agent, or Firm*—H. Jay Spiegel

[57] ABSTRACT

A motion detector includes a plurality of electrically conductive spheres contained within a chamber having a height slightly greater than the sphere diameter. In a first embodiment, a top wall of the chamber consists of a circuit board having a pattern of conductive metal installed thereon including one pattern for one conductor and another pattern for another conductor with the two patterns being interrelated so that spheres rolling within the chamber can make and break electrical circuits. In a second embodiment, both the top and bottom walls of the chamber consist of circuit boards having patterns of conductive metal thereon. In either embodiment, the pattern of conductive metal may be spiral-shaped, either circular or elliptical, concentric circles or concentric ellipses, an array of dots or an array of rectangles.

7 Claims, 2 Drawing Sheets

MULTIPLE SPHERE MOTION DETECTOR

BACKGROUND OF THE INVENTION

The present invention relates to a multiple sphere motion detector. In the prior art, motion detectors are known. However, Applicant is unaware of any such device incorporating all of the features and aspects of the present invention. The following prior art is known to Applicant:

U.S. Pat. No. 3,619,524 to Gillund

U.S. Pat. No. 3,701,093 to Pick

U.S. Pat. No. 3,742,478 to Johnson

U.S. Pat. No. 3,831,163 to Byers

U.S. Pat. No. 4,293,860 to Iwata

U.S. Pat. No. 4,349,809 to Tomes

U.S. Pat. No. 5,010,893 to Sholder

U.S. Pat. No. 5,153,566 to Yun.

None of these references taken alone or in combination with any other reference or references teaches a motion detector including the combination of features and elements as set forth in the present invention, including the use of a plurality of conductive spheres contained within a chamber having at least one wall with conductive metal applied on a surface thereof in the pattern or patterns described hereinafter.

SUMMARY OF THE INVENTION

The present invention relates to a multiple sphere motion detector. The present invention includes the following interrelated objects, aspects and features:

(1) In a first aspect, the present invention contemplates a housing having top and bottom flat walls spaced from one another and, in conjunction with a peripheral wall, defining an internal chamber within which a plurality of identical spheres are disposed. The spacing between the top and bottom walls is slightly greater than the common diameter of the spheres.

(2) In one embodiment, one of the top or bottom surfaces has disposed thereon a pattern of electrically conductive metal including some portions on one side of an electrical circuit and other portions on another side of an electrical circuit such that movement of the spheres within the chamber may, from time-to-time, cause closure of one or more circuit paths.

(3) The device as described above is limited in its effectiveness due to the fact that only one of the top and bottom walls has the pattern of electrically conductive metal thereon. In order to make the device omnidirectional, in a second embodiment, both the top and bottom walls have patterns of conductive metal disposed thereon.

(4) In the preferred embodiment, the top and bottom walls have flat surfaces and the patterns of electrically conductive metal are disposed thereon protruding outwardly from each respective surface. If desired, and to enhance the free movement of the spheres within the chamber, recesses may be formed in the top and/or bottom walls to allow the patterns of electrically conductive metal to be recessed into each surface so that the surface of the wall including the top surfaces of the electrically conductive metal and the adjacent surfaces of the wall lie in a common plane so that a smooth surface is provided that enhances movements of spheres thereon.

(5) In each embodiment, Applicant has devised a number of embodiments of patterns of conductive metal that may be employed effectively in accordance with the teachings of the present invention. These patterns may be described as follows: a pair of spiral-shaped patterns that overlap with one another to allow a large number of areas of adjacency between the conductors to allow the plurality of spheres to close many circuits thereon. Alternatively, the pattern may be oval-shaped. In third and fourth embodiments, the electrically conductive pattern may consist of a plurality of concentric circles. Alternatively, the concentric circles may be replaced with concentric ovals or ellipses. In further embodiments, the pattern may consist of an array of dots or an array of rectangles or squares.

Accordingly, it is a first object of the present invention to provide a multiple sphere motion detector.

It is a further object of the present invention to provide such a device with the housing defined by top and bottom flat walls which along with a peripheral wall define a chamber in which a multiplicity or plurality of electrically conductive spheres are contained.

It is a yet further object of the present invention to provide such a device wherein one or both of the top and bottom surfaces has (have) disposed thereon a pattern of electrically conductive metal.

It is a yet further object of the present invention to provide such a device wherein the patterns of electrically conductive metal may comprise spirals, concentric circles or ovals, arrays of dots, squares or rectangles.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
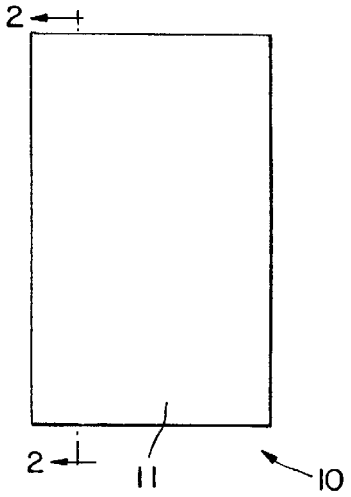
FIG. 1 shows a top view of the present invention.
Figure 2:
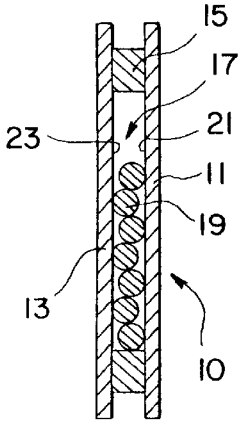
FIG. 2 shows a cross-sectional view along the line 2—2 of FIG. 1.

Reference is first made to FIGS. 1 and 2 which depict a typical housing for the present invention designated by the reference numeral 10 and which includes a top wall 11, a bottom wall 13, and a peripheral wall 15 that define, therebetween, an internal chamber 17. Within the chamber 17 are disposed a multiplicity of electrically conductive spheres 19, up to 50 in number, having identical diameters, as best seen in FIG. 2, slightly smaller than the distance between chamber defining surfaces of the parallel walls 11 and 13. The peripheral wall 15 is preferably made of an insulative material. Furthermore, the peripheral wall 15 may be square, rectangular or circular, as desired.

Figure 3:
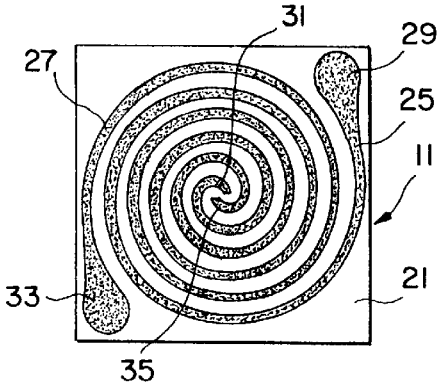
FIG. 3 shows a first embodiment of an electrically conductive pattern.

FIG. 3 shows the wall 11 as having a surface 21 that is the chamber defining surface as seen in FIG. 2. The wall 11 comprises a circuit board and, as seen in FIG. 3, a pattern of electrically conductive metal is printed thereon including a first spiral-shaped contact 25 and a second spiral-shaped contact 27. The contact 25 has a first end 29 adjacent the periphery of the wall 11 and a second end 31 at the center of the wall 11. The contact 27 has a first end 33 diagonally opposed to the end 29 of the contact 25 and a second end 35 at the center of the wall 11 and adjacent the end 31 of the contact 25. As seen in the figure, the spiral configurations of the contacts 25 and 27 overlap one another such that, at any point along the path of each contact 25 or 27, there is a closely adjacent portion of the other contact 27 or 25. Toward the center of the wall 11, each contact 25 or 27 is surrounded on both sides with portions of the other contact 27 or 25. In this way, as should be understood, when a plurality of spheres 19 are rolling on the surface 21 of the wall 11, a circuit path between the ends 29 and 33 may be completed at numerous locations along the respective paths of the contacts 25 and 27 by virtue of (1) engagement of one or more spheres between locations on the contacts 25, 27, and (2) interengagement between adjacent electrically conductive spheres 19. Given the differing lengths of the path that electrical current will take based upon the different points of engagement of the spheres 19 on the contacts 25, 27, differences in total circuit resistance can easily be measured. Such resistance changes cause corresponding changes in circuit voltage allowing sensing of movements of the spheres 19 corresponding to movements of the sensor 10.

With reference back to FIGS. 1 and 2, if it is desired to make the sensor 10 unidirectional, only the wall 11 is provided with the contacts 25 and 27. If, alternatively, it is desired to allow the sensor 10 to operate omni-directionally, in such instance, the contacts 25 and 27 are also printed on the inner surface 23 of the bottom wall 13 of the sensor 10. Thus, as should be understood from FIG. 2, no matter what orientation is imposed upon the sensor 10, one or more spheres 19 will engage either one or both of the surfaces 21, 23, thereby causing the corresponding voltage changes that result in indications of movement of the sensor 10.

Figure 10:
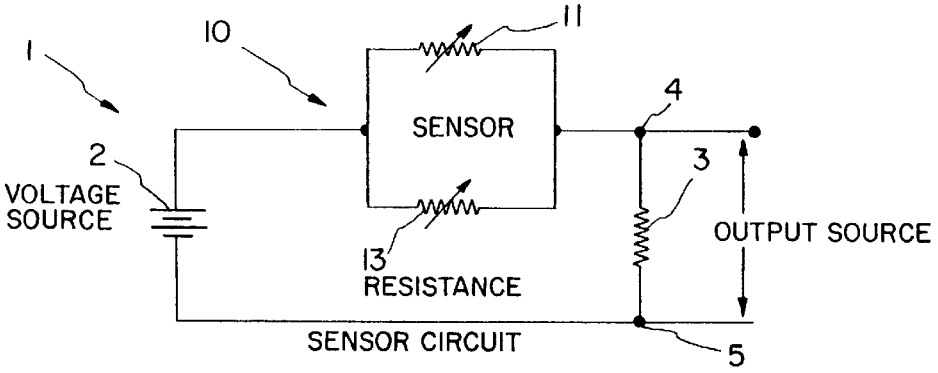
FIG. 10 shows a schematic representation of an electrical circuit usable in accordance with the teachings of the present invention.

FIG. 10 shows a schematic representation of an electrical circuit useable in accordance with the teachings of the present invention. The circuit 1 includes a source of voltage 2 and the reference numeral 3 schematically represents system resistance. The terminals 4 and 5 are provided to facilitate measurement of output voltage. The sensor 10 is incorporated into the circuit 1 and for ease of understanding, the reference numerals 11 and 13 are used to depict the variable resistances shown which correspond to the embodiment described above wherein each of the surfaces 21 and 23 has the contacts 25, 27 printed thereon.

In the embodiment wherein only one of the walls 11 or 13 has the contacts 25, 27 printed thereon, the circuit 1 would merely be modified by eliminating one of the variable resistors 11, 13. As is clear from FIG. 10, given the parallel relationship of the variable resistors 11, 13 in the circuit, movements of spheres 19 with respect to either of the surfaces 21 or 23 will result in changes in circuit resistance and changes in the output voltage read across the terminals 4 and 5 of the resistor 3.

Figure 4:
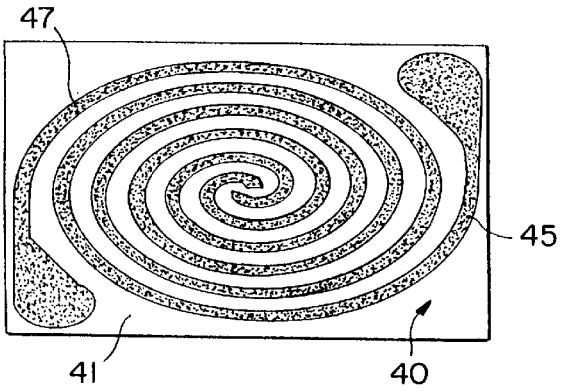
FIG. 4 shows a second embodiment of an electrically conductive pattern.

With reference back to FIG. 3, it is seen that the contacts 25, 27 create a generally circular pattern. With reference to FIGS. 4–8, additional contact patterns are depicted. Thus, FIG. 4 shows a wall 40 corresponding to the wall 11 having a surface 41 corresponding to the surface 21 and having printed thereon contacts 45 and 47 similar to the contacts 25 and 27 but creating an overall pattern that is oval-shaped or elliptically-shaped.

Figure 5:
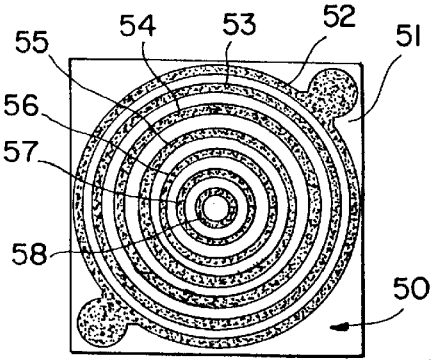
FIG. 5 shows a third embodiment of an electrically conductive pattern.
Figure 9:
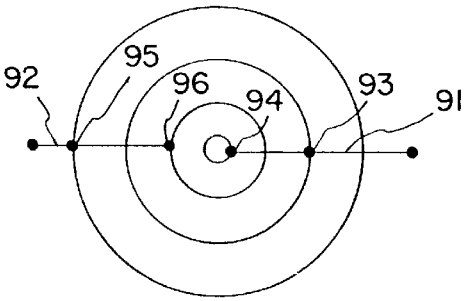
FIG. 9 shows a view from the other side as compared to FIG. 5 depicting a preferred manner of electrical interconnection of circuitry of the present invention.

FIG. 5 shows a wall 50 having a surface 51 on which are imprinted concentric contact circles 52, 53, 54, 55, 56, 57 and 58. (Of course, a circle is a circular ellipse.) With reference to FIG. 9, electrical conductors 91 and 92 may be connected to the concentric circles 52–58 with conductor 91 being electrically connected to every other circular contact by, for example, the connections 93 and 94, and with the electrical conductor 92 being electrically connected to every other contact circle, between the circles engaged by the conductor 91 with the contacts 95 and 96. In this way, as should be understood from comparison of FIGS. 5 and 9, the circles 52, 54, 56 and 58 are electrically connected together and the circles 53, 55 and 57 are electrically connected together so that as spheres 19 roll over the surface 51, various electrical paths are closed having varying distances and, thus, varying resistances that can easily be measured.

Figure 6:
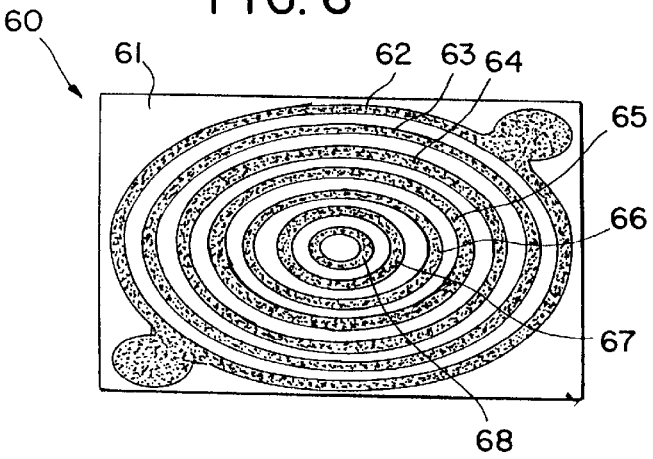
FIG. 6 shows a fourth embodiment of an electrically conductive pattern.

FIG. 6 shows a wall 60 having a surface 61 on which are printed oval-shaped or elliptically-shaped contacts 62–68. Interconnection of these contacts is accomplished in a manner corresponding to that which is depicted in FIG. 9 and, other than the oval-shaped or elliptically-shaped configuration of the contacts of FIG. 6, the FIG. 6 embodiment operates in a manner corresponding to the manner of operation of FIG. 5.

Figure 7:
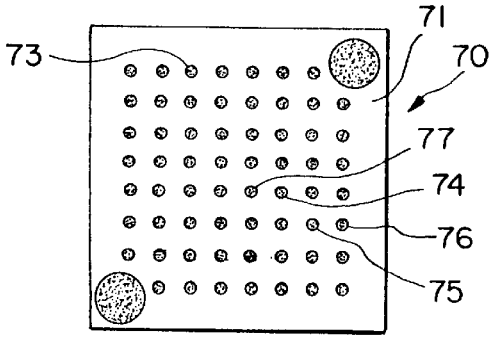
FIG. 7 shows a fifth embodiment of an electrically conductive pattern.

FIG. 7 depicts a wall 70 having a surface 71 on which an array of electrically conductive dots 73 are disposed. As should be understood from FIG. 9, the array of contact dots 73 is incorporated into an electrical circuit by electrically interconnecting alternating dots together. For example, the dots 74 and 76 are interconnected together on one side of a circuit and the dots 75 and 77 are interconnected onto another side of the circuit. In this way, as spheres 19 roll over the surface 71, multiple electrically conductive paths are closed of varying lengths resulting in various resistances readable as variations in voltage output.

Figure 8:
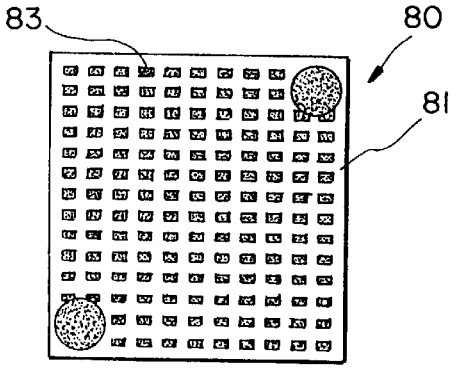
FIG. 8 shows a sixth embodiment of an electrically conductive pattern.

Similarly to the embodiment of FIG. 7, FIG. 8 shows a wall 80 having a surface 81 on which a plurality of electrically conductive rectangles 83 are printed. Other than the rectangular shape of the contacts 83, operation of the embodiment of FIG. 8 and the electrical interconnection thereof into a sensor circuit are identical to the description set forth hereinabove with regard to FIG. 7.

Figure 11:
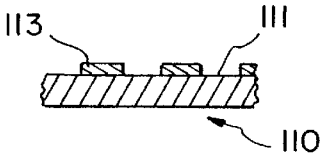
FIG. 11 shows a cross-sectional view through a typical wall with contacts printed thereon above a surface thereof.

FIG. 11 shows a circuit board 110 having a surface 111 on which electrically conductive contact material 113 is printed. As seen in FIG. 11, the material 113 is wholly on top of the surface 111. While the height of the contact material 113 is somewhat exaggerated in FIG. 11 to show detail, when spheres 19 roll on the surface 111, the height of the contact material 113 above the surface 111 provides some resistance to smooth rolling of the spheres 19 thereover.

Figure 12:
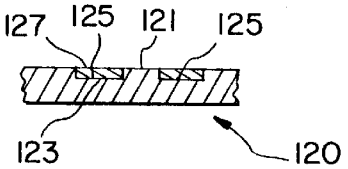
FIG. 12 shows a cross-sectional view similar to that of FIG. 11 but with contacts embedded within recesses formed in a circuit board.

In this regard, FIG. 12 shows a circuit board 120 having a surface 121 into which are formed recesses 123 within which are embedded electrically conductive target material 125 having top surfaces 127 flush with the surface 121 of the circuit board 120 so that the surface consisting of the surfaces 121 and 127 is smooth. Thus, when spheres 19 roll on the surface 121, 127, frictional resistance to rolling is drastically reduced as compared to the situation depicted in FIG. 11.

Either of the configurations set forth in FIGS. 11 and 12 may be employed with any of the embodiments set forth in FIGS. 3–8.

Applicant has found that the patterns depicted in FIGS. 3 and 5 are particularly effective where the configuration shown in FIG. 11 is employed. In this regard, concerning the patterns depicted in FIGS. 3 and 5, when the spheres 19 are moved with respect to the contact patterns thereof, resistance to movements of the spheres 19 is somewhat reduced as compared to the other patterns shown in FIGS. 4, 6, 7 and 8. Concerning the patterns depicted in FIGS. 4 and 6, the system exhibits increased sensitivity along the respective long axes thereof as compared to the short axes thereof.

In the preferred embodiment of the present invention, the spheres 19 may be made of any desired material coated with an electrically conductive coating such as, for example, gold plating, nickel plating, tin plating and tin-lead plating. Such gold plating may also be employed on the contacts printed on the circuit boards to enhance conductivity.

If desired, as many as fifty spheres 19 may be contained within the chamber 17. One example of a sensor that could be made in accordance with the teachings of the present invention consists of walls 11 and 13 having facing surfaces 21 and 23 separated by a distance of 0.04 inches with the spheres 19 having respective diameters of 0.03 inches and with the walls 11, 13 being square with sides of 0.75 inches each. Of course, these dimensions are merely exemplary and any appropriate dimensions may be suitably employed.

As such, an invention has been disclosed in terms of preferred embodiments thereof which fulfill each and every one of the objects of the invention as set forth hereinabove and provide a new and useful multiple sphere motion detector of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An omni-directional motion detector comprising:

a) a housing having parallel top and bottom flat walls spaced apart a spacing distance by an insulative spacer wall, said walls defining a chamber;

b) a multiplicity of identical spheres having electrically conductive surfaces disposed within said chamber and freely movable therein, said spheres having diameters slightly smaller than said spacing distance;

c) each of said top wall and bottom wall having an internal surface with a generally elliptical pattern of electrical contacts thereon, each said pattern consisting of a first continuous circuit portion and a second continuous circuit portion, each of said circuit portions including a plurality of arcuate contact portions, with said arcuate contact portions of said first circuit portion alternating adjacently with arcuate contact portions of said second contact portion;

d) whereby, when said spheres roll on said internal surfaces, electrical interconnections between said first and second circuit portions of said respective internal surfaces via said spheres occur which may be detected to detect motion of said housing.

2. The detector of claim 1, wherein said circuit portions are spiral-shaped.

3. The detector of claim 2, wherein said generally elliptical pattern comprises a generally circular pattern.

4. The detector of claim 1, wherein said circuit portions are concentric with respect to one another.

5. The detector of claim 1, wherein said electrical contacts are embedded within said internal surfaces and have outer surfaces flush with said internal surfaces whereby said internal surfaces and outer surfaces combine to form smooth continuous rolling surfaces for said spheres.

6. An omni-directional motion detector comprising:

a) a housing having parallel top and bottom flat walls spaced apart a spacing distance by an insulative spacer wall, said walls defining a chamber;

b) a multiplicity of identical spheres having electrically conductive surfaces disposed within said chamber and freely movable therein, said spheres having diameters slightly smaller than said spacing distance;

c) each of said top wall and bottom wall having an internal surface with an array of electrical contact rectangular dots thereon, said array consisting of a first circuit portion and a second circuit portion, each of said circuit portions including a plurality of contact dots, with said contact dots of said first circuit portion alternating in close adjacency with said contact dots of said second contact portion;

d) whereby, when said spheres roll on said internal surfaces, electrical interconnections between said first and second circuit portions of said respective internal surfaces via said spheres occur which may be detected to detect motion of said housing.

7. The detector of claim 6, wherein said electrical contact dots are embedded within said internal surface and have outer surfaces flush with said internal surface whereby said internal surface and outer surfaces combine to form a smooth continuous rolling surface for said spheres.

* * * * *